US007350319B2

(12) United States Patent
Kim et al.

(10) Patent No.: US 7,350,319 B2
(45) Date of Patent: Apr. 1, 2008

(54) CLOTHING DRYER

(75) Inventors: Jin Doo Kim, Suwon-Si (KR); Woo Sup Jung, Suwon-Si (KR)

(73) Assignee: Samsung Electronics Co., Ltd., Suwon (KR)

( * ) Notice: Subject to any disclaimer, the term of this patent is extended or adjusted under 35 U.S.C. 154(b) by 68 days.

(21) Appl. No.: 11/138,414

(22) Filed: May 27, 2005

(65) Prior Publication Data

US 2006/0048406 A1 Mar. 9, 2006

(30) Foreign Application Priority Data

Sep. 6, 2004 (KR) ..... 10-2004-0070822
Sep. 6, 2004 (KR) ..... 10-2004-0070823
Sep. 20, 2004 (KR) ..... 10-2004-0075195

(51) Int. Cl.
*F26B 11/02* (2006.01)

(52) U.S. Cl. ..... 34/603

(58) Field of Classification Search ..... 34/602, 34/603, 606

See application file for complete search history.

(56) References Cited

U.S. PATENT DOCUMENTS 5,555,647 A * 9/1996 Torborg et al. ..... 34/601
6,874,248 B2 * 4/2005 Hong et al. ..... 34/239

FOREIGN PATENT DOCUMENTS

| | | | |
|---|---|---|---|
| EP | 0 725 180 | B1 | 8/1996 |
| JP | 58-112433 | A | 7/1983 |
| JP | 01-285299 | A | 11/1989 |
| JP | 04-276299 | A | 10/1992 |
| JP | 08-220773 | A | 8/1996 |
| KR | 10-1997-0010084 | A | 6/1997 |
| KR | 20-2000-0019457 | U | 11/2000 |
| KR | 20-0264574 | Y1 | 2/2002 |
| KR | 20-0270210 | Y1 | 3/2002 |
| KR | 10-2003-0002589 | A | 1/2003 |
| KR | 10-2004-0020655 | A | 3/2004 |
| KR | 10-2004-0023999 | B1 | 3/2004 |
| KR | 10-2004-0036530 | A | 4/2004 |

* cited by examiner

*Primary Examiner*—S. Gravini
(74) *Attorney, Agent, or Firm*—Sughrue Mion, PLLC

(57) ABSTRACT

A clothing dryer is provided having improved blowing fan, fan casing, and motor bracket fixing structures. The clothing dryer includes a housing forming the appearance of the clothing dryer, a drying tub rotatably mounted in the housing, a blowing fan to discharge air out of the drying tub, a fan casing to guide the flow of air around the blowing fan, a driving motor to rotate the blowing fan, a motor bracket to support the driving motor, and a fixing part to temporarily fix the blowing fan to the fan casing when fixing units, by which the blowing fan is attached to a driving shaft of the driving motor, are loosened and tightened.

9 Claims, 11 Drawing Sheets

CLOTHING DRYER

CROSS-REFERENCE TO RELATED APPLICATIONS

This application claims priority from Korean Patent Application Nos. 2004-70822, 2004-70823, both filed Sep. 6, 2004, and 2004-75195, filed on Sep. 20, 2004 in the Korean Intellectual Property Office, the disclosures of which are incorporated herein by reference.

BACKGROUND OF THE INVENTION

1. Field of the Invention

The present invention relates to a clothing dryer and, more particularly, to blowing fan, fan casing, and motor bracket fixing structures of the clothing dryer.

2. Description of the Related Art

A clothing dryer is an apparatus that supplies hot air to a drying tub, in which objects to be dried, such as wet clothes, are put, to evaporate moisture contained in the objects, and therefore, to dry the objects. Such a clothing dryer comprises: a housing forming the appearance of the clothing dryer; a drying tub rotatably mounted in the housing; an inlet duct to supply hot air to the drying tub; an outlet duct to discharge air out of the drying tub; a blowing fan to generate a blowing force necessary to discharge air out of the drying tub; a discharge pipe to discharge air blown from the blowing fan out of the drying dryer; and a driving motor to rotate the blowing fan and the drying tub.

The driving motor has a driving shaft, to which the blowing fan is directly connected. When the blowing fan is to be disassembled from the driving motor due to a clothing dryer malfunction and then the blowing fan is to be assembled to the driving motor again, it is necessary to fix the blowing fan such that the driving shaft does not rotate before loosening and tightening fixing nuts, by which the blowing fan is attached to the driving shaft. However, there have been proposed no appropriate means to fix the blowing fan, and therefore, disassembly and assembly of the blowing fan are difficult.

Around the blowing fan is disposed a fan casing, which guides the flow of air. The fan casing, which is generally manufactured of injected plastic resin, may shake due to irregular flow of air generated when the blowing fan is rotated. When the fan casing shakes as described above, the blowing fan collides with the fan casing, and therefore, the blowing fan is not properly rotated. Furthermore, the blowing fan and the fan casing may be damaged.

At a base, which forms the bottom of the housing, is disposed a motor bracket to support both sides of the driving motor. However, the motor bracket is fixed to the base by a plurality of fixing screws, and therefore, the fixing of the motor bracket to the base is complicated, which increases the manufacturing costs and decreases productivity.

SUMMARY OF THE INVENTION

Therefore, it is an aspect of the invention to provide a clothing dryer that enables a blowing fan to be easily assembled and disassembled, thereby accomplishing easy and convenient repair and maintenance.

It is another aspect of the invention to provide a clothing dryer that prevents a fan casing from shaking, thereby accomplishing smooth operation of the blowing fan and preventing the blowing fan and the fan casing from being damaged.

It is yet another aspect of the invention to provide a clothing dryer that enables a motor bracket to be easily assembled using a reduced number of parts, thereby improving productivity.

In accordance with one aspect, the present invention provides a clothing dryer comprising: a housing forming the appearance of the clothing dryer; a drying tub rotatably mounted in the housing; a blowing fan to discharge air out of the drying tub; a fan casing to guide the flow of air around the blowing fan; a driving motor to rotate the blowing fan; a motor bracket to support the driving motor; and a fixing part to temporarily fix the blowing fan to the fan casing when fixing units, by which the blowing fan is attached to a driving shaft of the driving motor, are loosened and tightened.

The fixing part may comprise: a fixing hole formed at the blowing fan, a predetermined fixing member being inserted through the fixing hole; and a supporting boss formed at the fan casing, the supporting boss corresponding to the fixing hole, the supporting boss having a blind bore, into which the fixing member is inserted through the fixing hole. The motor bracket is provided with a guide hole, through which the supporting boss is inserted.

The fan casing may be provided at the rear part thereof with a supporting rib extending outward, by which the fan casing is supported by the driving motor. The supporting rib hermetically seals the space around a shaft through-hole formed at the rear part of the fan casing for allowing the driving shaft of the driving motor to be inserted therethrough.

The motor bracket may be fixed to the base, which forms the bottom of the housing, the motor bracket is provided with fixing clips, and the base is provided with insertion holes, into which the fixing clips of the motor bracket are fitted, respectively. The fixing clips are disposed at one side of the motor bracket, and the other side of the motor bracket is fixed to the base by fixing units. The insertion holes are provided at the edges thereof with supporting parts to support the fixing clips, respectively, the supporting parts being bent downward from the edges of the insertion holes or embossed, respectively.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

Figure 1:
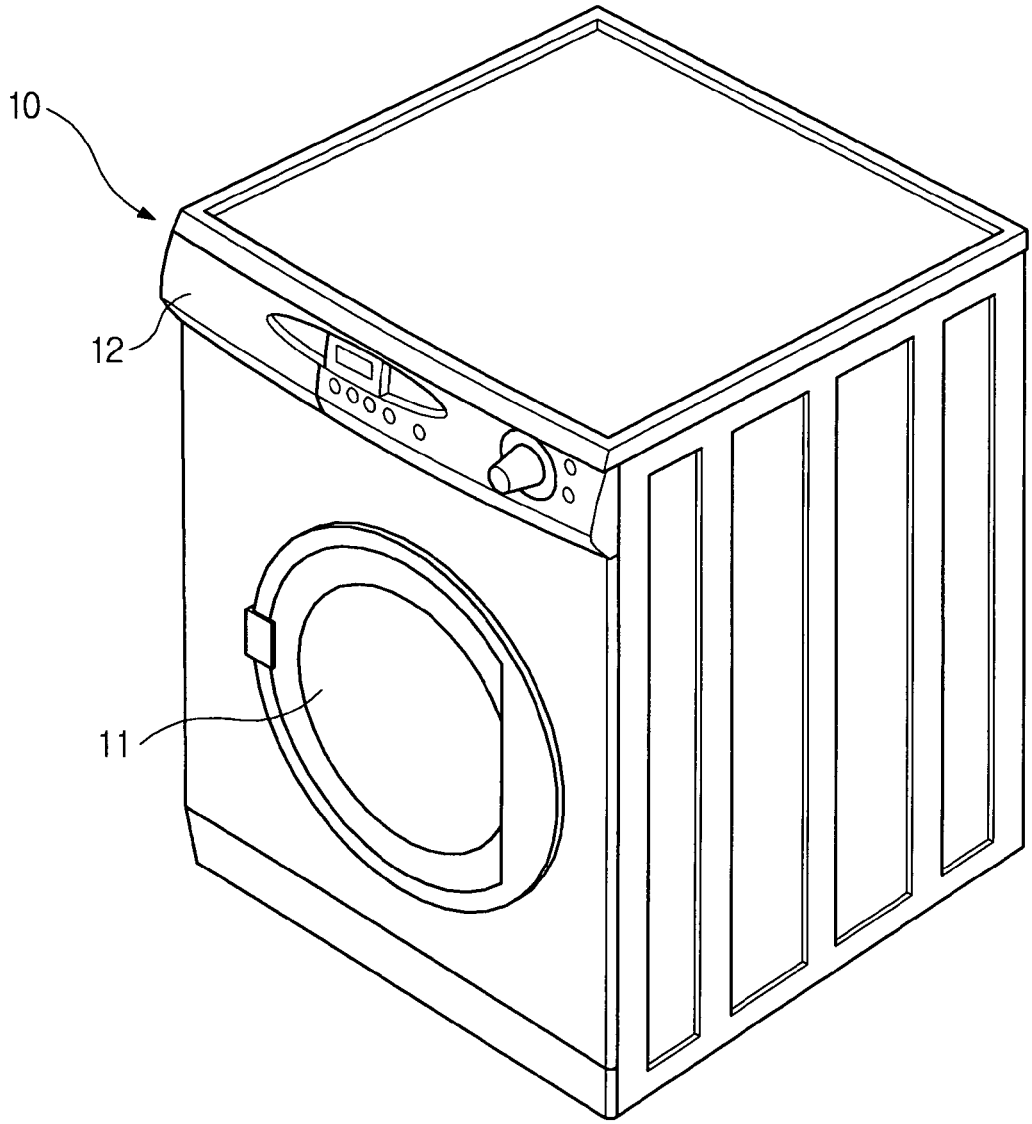
FIG. 1 is a perspective view showing the appearance of a clothing dryer according to an exemplary embodiment of the present invention.

DETAILED DESCRIPTION OF THE ILLUSTRATIVE, NON-LIMITING EMBODIMENTS OF THE INVENTION

Reference will now be made in detail to the illustrative, non-limiting embodiments of the present invention, examples of which are illustrated in the accompanying drawings, wherein like reference numerals refer to like elements throughout. The exemplary embodiments are described below to explain the present invention by referring to the figures.

Referring to FIG. 1, a clothing dryer according to an exemplary embodiment of the present invention comprises a housing 10, which forms the appearance of the clothing dryer. To the front part of the housing 10 is hingedly attached a door 11 such that the door 11 can be opened for allowing objects to be dried to be put into the housing 10 and can be closed for preventing objects from being put into the housing 10. At the housing 10, above the door 11, is disposed a control unit 12 to control the overall operations of the clothing dryer.

Figure 2:
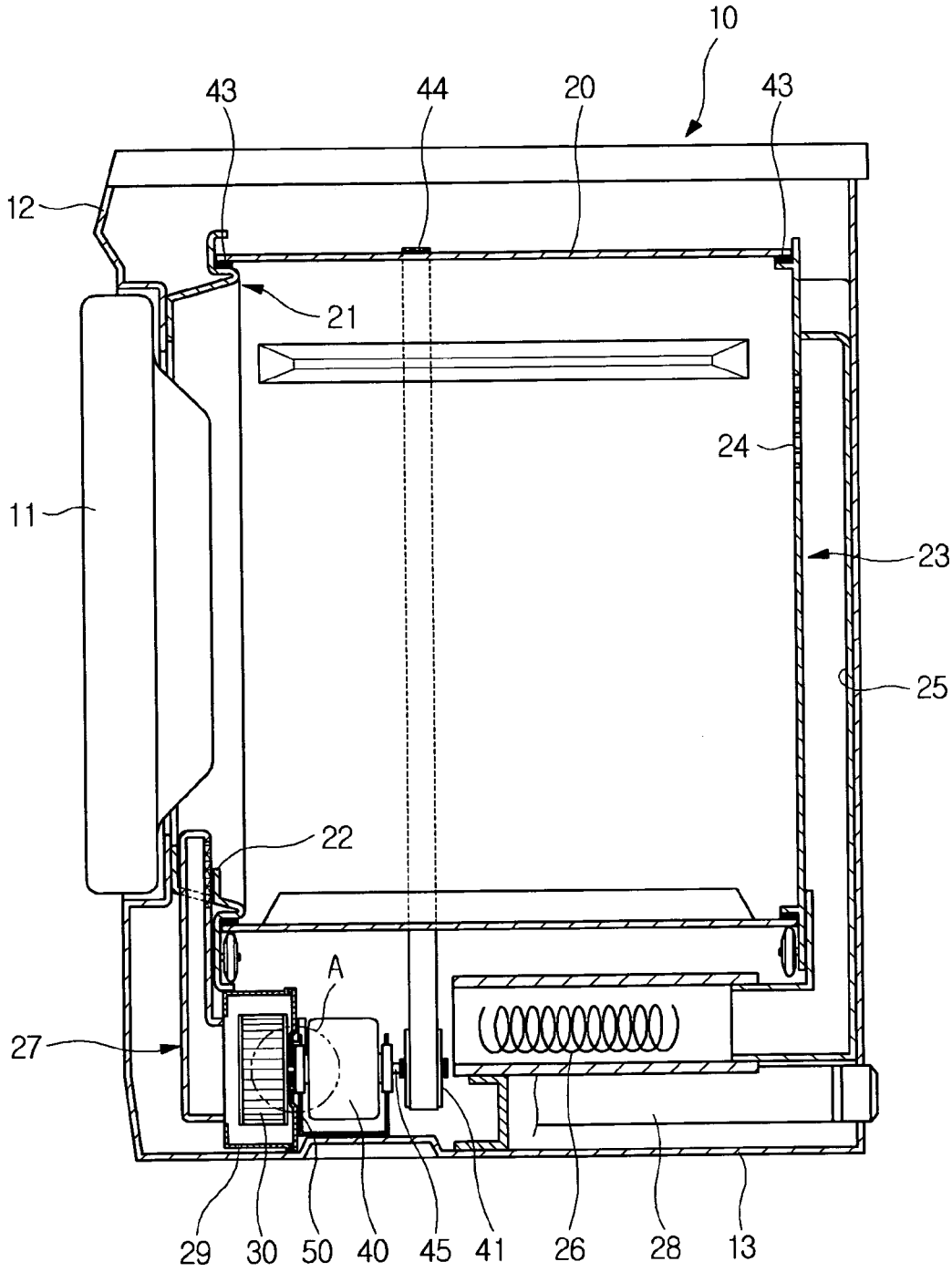
FIG. 2 is a side view, in section, showing the inner structure of the clothing dryer according to the embodiment of the present invention shown in FIG. 1.

Referring to FIG. 2, a cylindrical drying tub 20, which has open front and rear ends, is disposed in the housing 10. The drying tub 20 is supported by a front bracket 21 and a rear bracket 23. The front bracket 21 is in sliding contact with the inner circumferential surface of the drying tub 20 at the front end of the drying tub 20, and the rear bracket 23 is also in sliding contact with the inner circumferential surface of the drying tub 20 at the rear end of the drying tub 20. Between the drying tub 20 and the front bracket 21 and between the drying tub 20 and the rear bracket 23 are disposed sliding pads 43 to facilitate smooth rotation of the drying tub 20.

At the upper part of the rear bracket 23 are formed inlet openings 24, through which hot air is introduced into the drying tub 20. At the rear of the rear bracket 23 is disposed an inlet duct 25 to guide hot air to the inlet openings 24. The inlet duct 25 extends rearward below the drying tub 20, and is then bent upward such that the inlet duct 25 communicates with the inlet openings 24. At the entrance part of the inlet duct 25 is disposed a heater 26 to heat air introduced into the inlet duct 25 from the interior of the housing 10.

The front bracket 21 has an open center part, through which objects to be dried are put into the drying tub 20. At the lower part of the front bracket 21 are formed outlet openings 22, through which air containing moisture separated from the objects is discharged out of the drying tub 20.

Below the drying tub 20 are disposed an outlet duct 27, a blowing fan 30, and a discharge pipe 28, through which air from the outlet openings 22 is discharged out of the clothing dryer. The outlet duct 27 serves to guide air discharged from the outlet openings 22 to the space below the housing 10. The end of the outlet duct 27 is connected to the blowing fan 30, which generates a blowing force necessary to discharge air. Around the blowing fan 30 is disposed a fan casing 29 to guide the flow of air. The discharge pipe 28 has one end connected to the exit part of the fan casing 29 and the other end extending out of the housing 10. Air blown from the blowing fan 30 is discharged out of the housing 10 through the discharge pipe 28.

At the lower part of the housing 10 is mounted a driving motor 40 to drive the blowing fan 30 and the drying tub 20. The driving motor 40 has a driving shaft 45, which extends frontward and rearward from the driving motor 40. One end of the driving shaft 45 is directly connected to the blowing fan 30, and to the other end of the driving shaft 45 is attached a pulley 41 to drive the drying tub 20. The pulley 41 is connected to the drying tub 20 via a belt 44 such that the drying tub 20 is rotated as the driving motor 40 is operated.

The operation of the clothing dryer with the above-stated construction according to the present invention will be described.

When a user opens the door 11 to put objects to be dried, such as wet clothes, into the drying tub 20, and then manipulates the control unit 12 to operate the clothing dryer, the drying tub 20 and the blowing fan 30 are simultaneously rotated by the driving motor 40. As the drying tub 20 is rotated, the objects in the drying tub 20 are mixed, and therefore, uniformly dried. Air in the drying tub 20 is discharged out of the clothing dryer by the blowing force of the blowing fan 30, and air introduced into the inlet duct 25 from the interior of the housing 10 is supplied into the drying tub 20. The air introduced into the inlet duct 25 is heated to a high temperature by the heater 26, and therefore, the air is changed into hot air, which evaporates moisture contained in the objects to be dried. In this way, the drying operation of the clothing dryer is performed.

Figure 3:
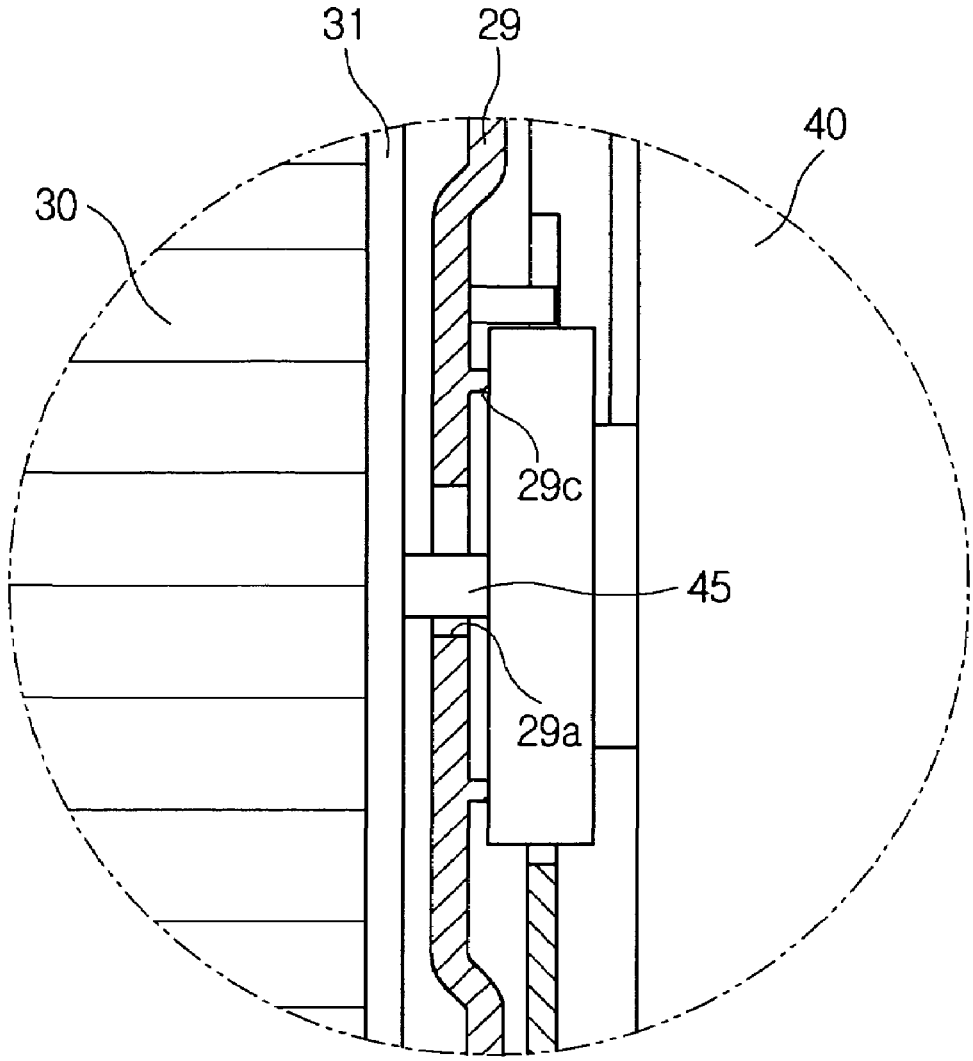
FIG. 3 is an enlarged view showing the "A" part of FIG. 2.

The lower part of the fan casing 29 is fixed to a base 13, which forms the bottom of the housing 10, by fixing units (not shown). As shown in FIG. 3, the fan casing 29 is provided at the rear part thereof, to which the driving motor 40 is opposite, with a shaft through-hole 29*a*, through which the driving shaft 45 is inserted. At the fan casing around the shaft through-hole 29*a* is formed a supporting rib 29*c*, which extends toward the driving motor 40. Preferably, but not necessarily, the supporting rib 29*c* is formed around the shaft through-hole 29*a* in the shape of a circle. The rear part of the fan casing 29 is securely attached to the driving motor 40 by the supporting rib 29*c*, and therefore, the fan casing 29 is prevented from being inclined rearward. In this way, the lower part of the fan casing 29 is fixed to the base 13, and the rear part of the fan casing 29 is securely attached to the driving motor 40 by the supporting rib 29*c*, and therefore, the fan casing 29 is prevented from shaking when an irregular flow of air is generated around the blowing fan 30. Also, the supporting rib 29*c* serves to hermetically seal the space between the fan casing 29 and the driving motor 40 around the shaft through-hole 29*a* for preventing foreign matter, such as dust or shag, from flowing out of the fan casing 29.

A blowing fan fixing structure according to the present invention will now be described.

Figure 4:
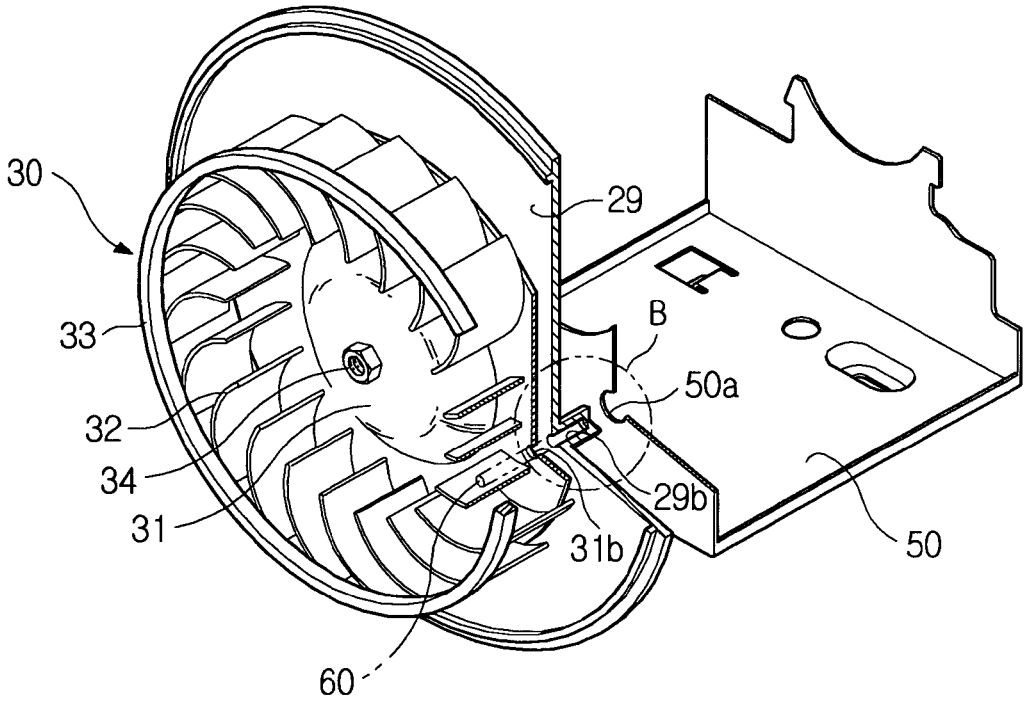
FIG. 4 is a perspective view showing a blowing fan fixing structure of a clothing dryer according to an embodiment of the present invention.

Referring to FIG. 4, the blowing fan 30 comprises: a disc part 31 having a center, to which is attached the driving shaft 45 of the driving motor 40; blades 32 arranged around the disc part 31; and a rim 33 to connect edges of the blades 32.

Figure 5:
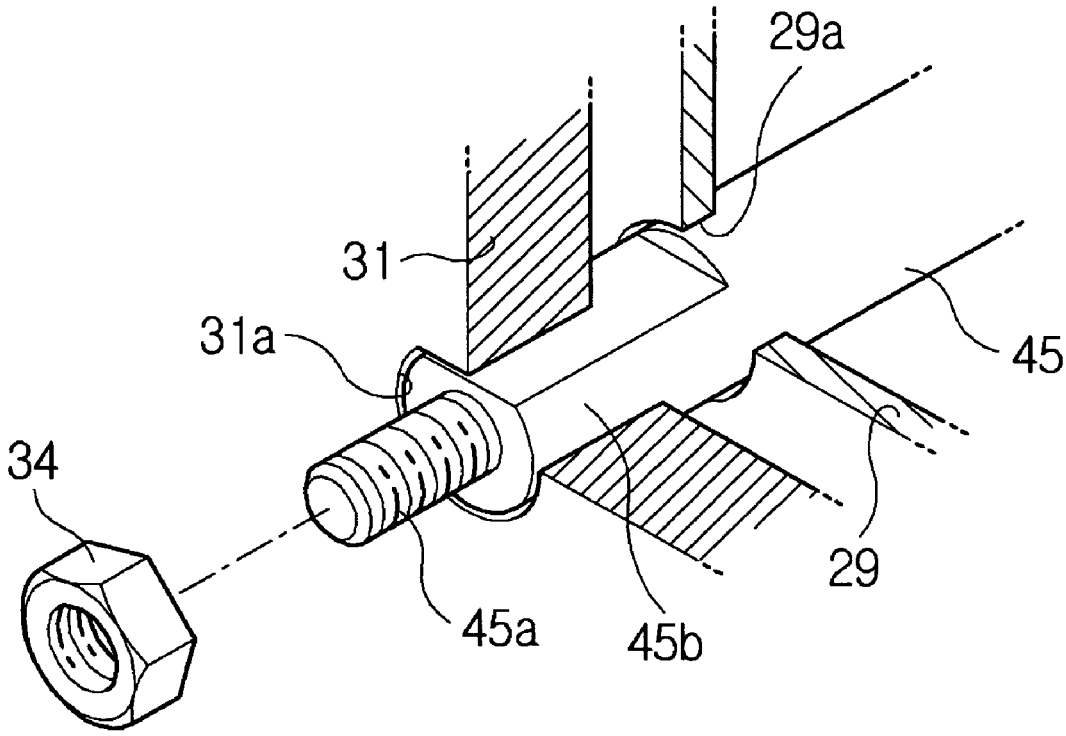
FIG. 5 is a perspective view showing a fixing structure between a driving shaft of a driving motor and a blowing fan of a clothing dryer according to an embodiment of the present invention.

The driving shaft 45 of the driving motor 40 is attached to the center of the disc part 31. As shown in FIG. 5, the driving shaft 45 is inserted in the fan casing 29 through the shaft through-hole 29*a* formed at the rear part of the fan casing 29. The driving shaft 45 is provided at the front end thereof with a male screw part 45*a*, on which a fixing nut 34 is fitted to fix the blowing fan 30, and an insertion part 45*b*, which is inserted in a center hole 31*a* of the disc part 31. The center hole 31*a* and the insertion hole 45*b* are formed in the shape of a "D", respectively, such that the rotating force of the driving shaft 45 is transmitted to the disc part 31.

Figure 6:
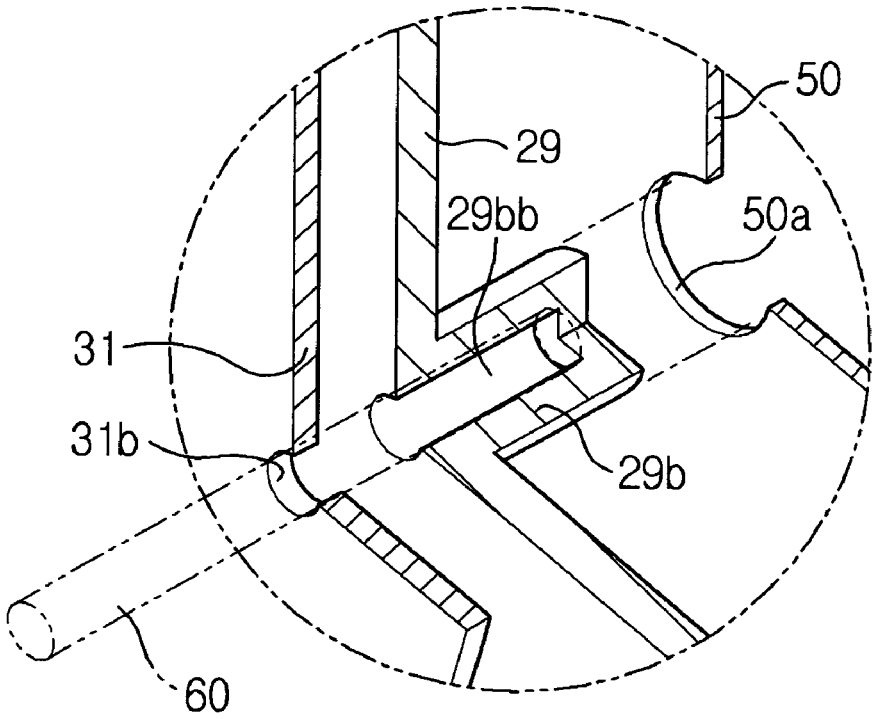
FIG. 6 is an enlarged view showing the "B" part of FIG. 4.

Referring to FIGS. 4 and 6, the rear part of the fan casing 29 is disposed at the rear of the blowing fan 30, and a motor bracket 50, which supports the driving motor 40, is disposed at the rear of the fan casing 29. The disc part 31 of the blowing fan 30 is provided at a position spaced a predetermined distance from the center thereof with a fixing hole 31*b*. The fan casing 29 is provided at a predetermined position thereof with a supporting boss 29*b*, which corresponds to the fixing hole 31*b* of the disc part 31 of the blowing fan 30. The supporting boss 29*b* of the fan casing 29 extends rearward. The supporting boss 29*b* has a blind bore 29*bb* longitudinally formed therein. When the blowing fan 30 is assembled or disassembled, a fixing member 60 having a predetermined strength is temporarily inserted into the blind bore 29*bb* of the supporting boss 29*b* through the fixing hole 31*b* for fixing the blowing fan 30.

At the motor bracket 50 is formed a guide hole 50*a*, through which the supporting boss 29*b* is inserted. Generally, the fan casing 29 is made of plastic resin while the motor bracket 50 is made of a high-strength iron plate. Consequently, the supporting boss 29*b* is supported by the guide hole 50*a*.

When the blowing fan is assembled or disassembled, the fixing member 60, which is formed in the shape of an iron core or a bar having predetermined strength, is inserted into the blind bore 29*bb* of the supporting boss 29*b* through the fixing hole 31*b* while the fixing hole 31*b* of the disc part 31 corresponds to the blind bore 29*bb* of the supporting boss 29*b*. As a result, the blowing fan 30 is fixed, and therefore, the driving shaft 45, to which the blowing fan 30 is attached, is also fixed. Consequently, the fixing nut 34 is easily loosened or fastened while the driving shaft 45 is fixed. The force transmitted to the driving shaft 45 when the fixing nut 34 is loosened or fastened is transmitted to the fixing member 60 through the blowing fan 30. The fixing member 60 is supported by the supporting boss 29*b* and the guide hole 50*a*, through which the supporting boss 29*b* is inserted.

Figure 7:
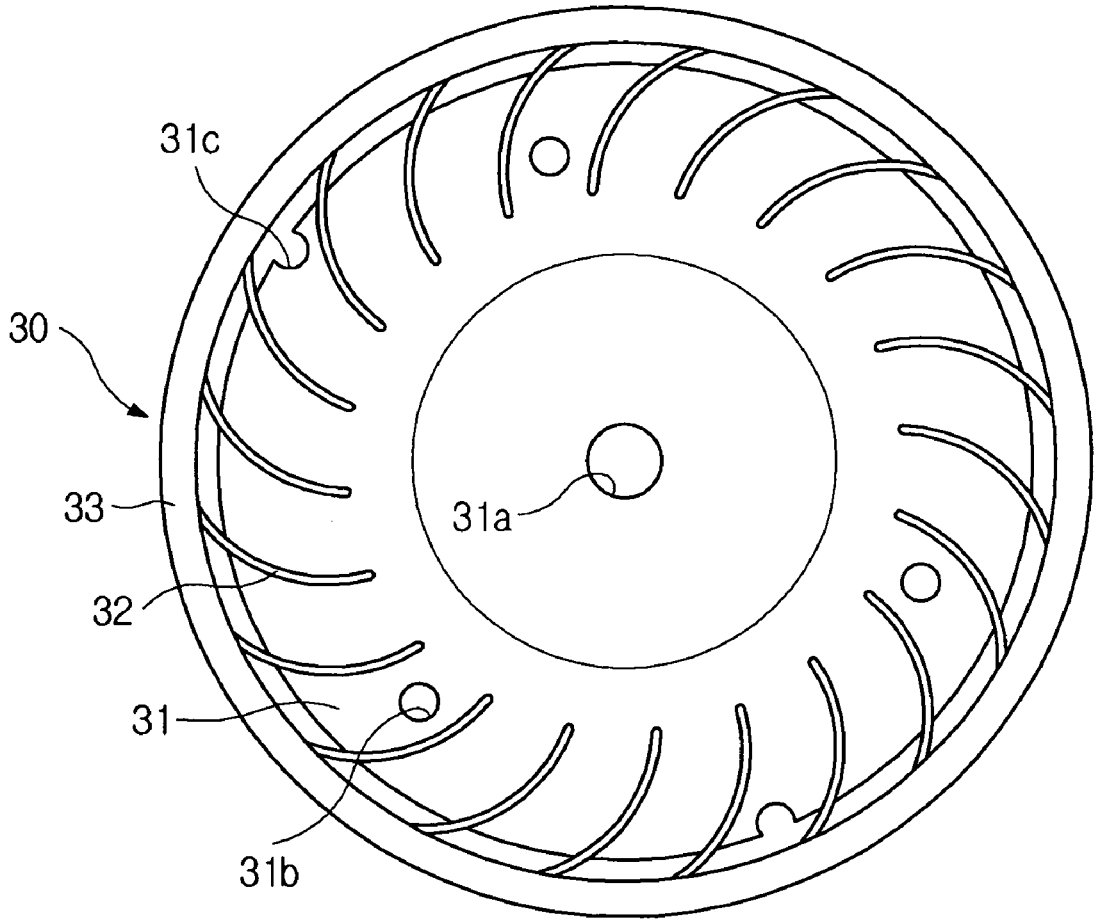
FIG. 7 is a front view showing a blowing fan of a clothing dryer according to another embodiment of the present invention.

FIG. 7 is a front view showing the structure of a blowing fan 30 of a clothing dryer according to another embodiment of the present invention. As shown in FIG. 7, the blowing fan 30 according to this embodiment is characterized in that the blowing fan 30 has a plurality of fixing holes 31*b*, or the disc part 31 of the blowing fan 30 is provided at the edge thereof with fixing grooves 31*c*, which perform the same function as the fixing holes 31*b*. In this case, the fan casing 29 is provided at the rear part thereof with supporting bosses 29*b*, which correspond to the fixing grooves 31*c* of the disc part 31 of the blowing fan 30. The supporting bosses 29*b* of the fan casing 29 have blind bores 29*bb*, into which fixing members 60 are temporarily inserted, respectively.

Now, a motor bracket mounting structure according to the present invention will be described.

Figure 8:
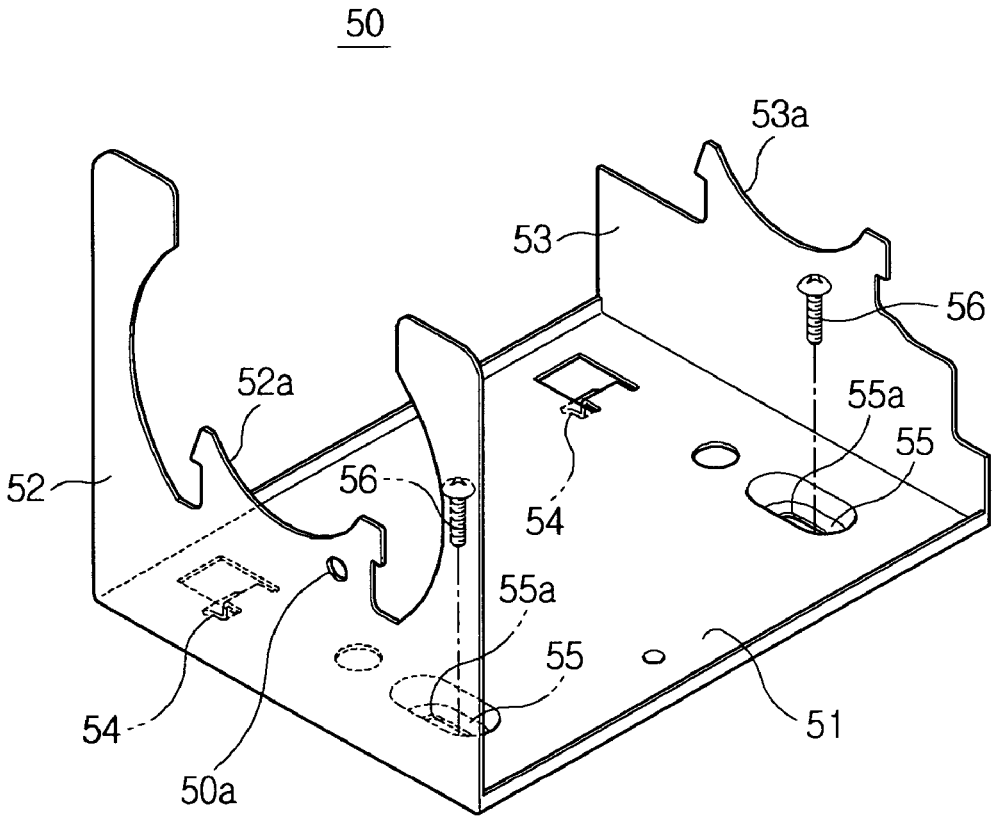
FIG. 8 is a perspective view showing a motor bracket of a clothing dryer according to an embodiment of the present invention.

As shown in FIG. 8, the motor bracket 50 comprises: a lower bracket part 51 fixed to the base 13; a front bracket part 52 bent upward from the front end of the lower bracket part 51 such that the front bracket part 52 is opposite to the blowing fan 30; and a rear bracket part 53 bent upward from the rear end of the lower bracket part 51. At the centers of the front bracket part 52 and the rear bracket part 53 are formed arc-shaped grooves 52*a* and 53*a*, respectively, by which both ends of the driving motor 40 are supported, respectively. The lower bracket part 51 of the motor bracket 50 is fixed to the base 13. Specifically, one side of the lower bracket part 51 is engaged with the base 13, and then the other side of the lower bracket part 51 is fixed to the base 13 by fixing screws 56. At one side of the lower bracket part 51 are formed two fixing clips 54, which are arranged at the front and rear parts of the lower bracket part 51, respectively. The fixing clips 54 are formed such that each of the fixing clips 54 has a downward-bent part and an outward-bent part connected to the downward-bent part. At the other side of the lower bracket part 51 are formed screw fixing parts 55 having rectangular holes 55*a*, through which the fixing screws 56 are inserted, respectively. Each of the screw fixing parts 55 extends downward from the lower bracket part 51. The screw fixing parts 55 are disposed at two positions while being opposite to the fixing clips 54, respectively.

Figure 9:
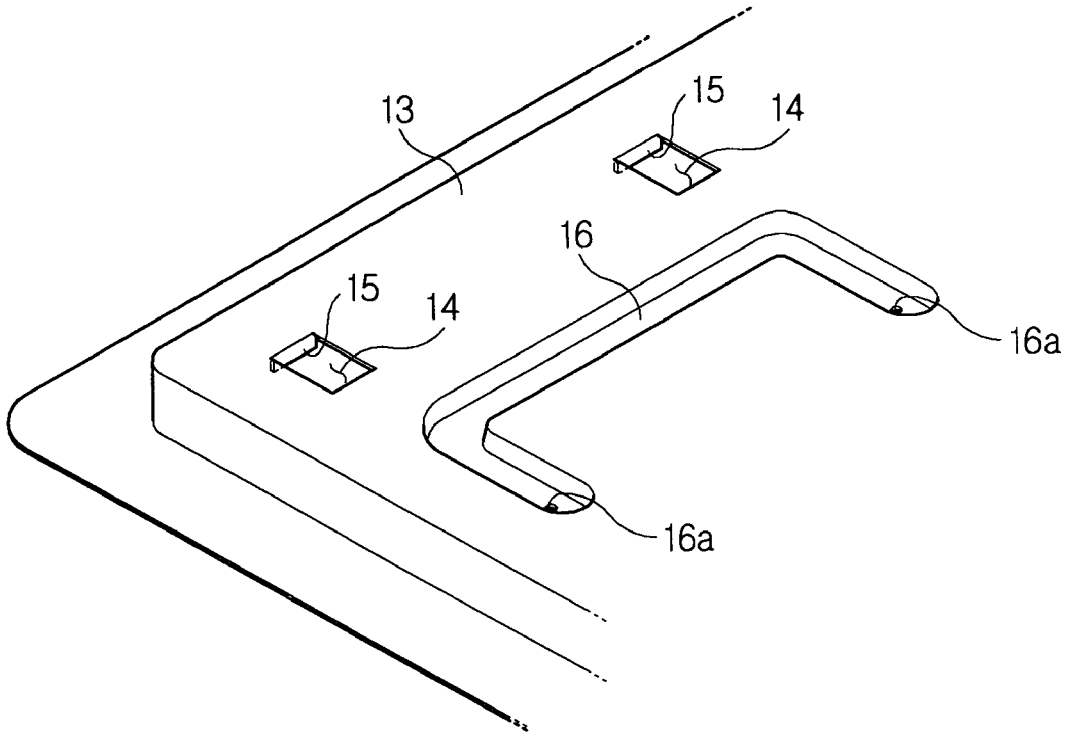
FIG. 9 is a perspective view, in part, showing a base of a clothing dryer according to an embodiment of the present invention.

Referring to FIG. 9, the base 13 is formed such that the inside part of the base 13 is protruded from the edge of the base 13. At the base 13 are formed insertion holes 14, into which the fixing clips 54 of the motor bracket 50 are fitted, respectively. At the outside parts of the insertion holes 14 are formed supporting parts 15, which are bent downward for pressing the fixing clips 54 downward, respectively. At the base 13 are also formed screw holes 16*a*, into which the fixing screws 56 are inserted through the screw fixing parts 55. The screw holes 16*a* are arranged such that the screw holes 16*a* are opposite to the insertion holes 14, respectively. The base 13 around the screw holes 16*a* is depressed to form a guide groove 16 that guides the screw fixing parts 55.

Figure 10:
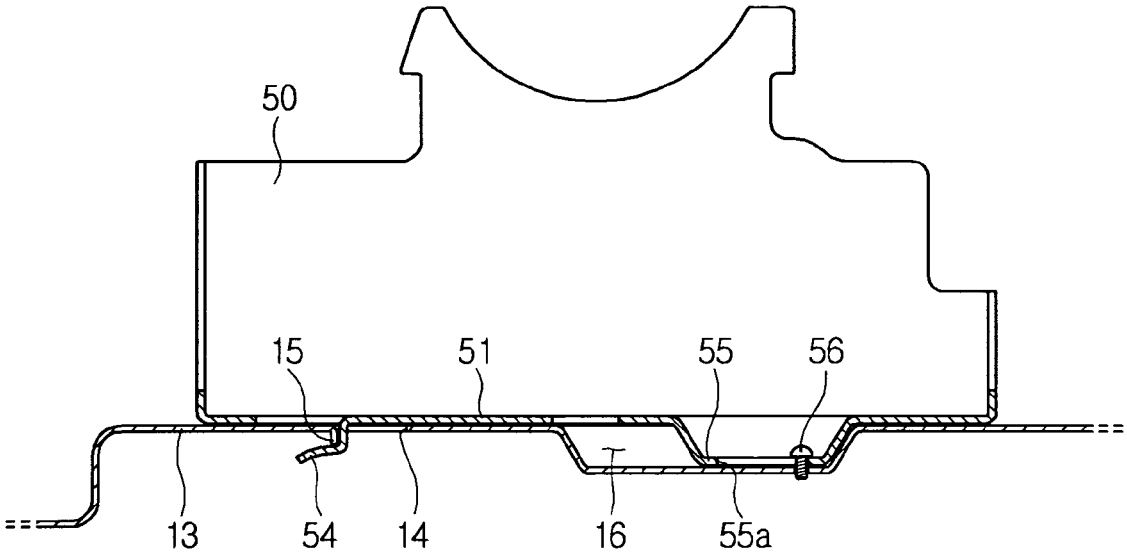
FIG. 10 is a sectional view showing a fixing structure between a motor bracket and a base of a clothing dryer according to an embodiment of the present invention.

FIG. 10 shows the motor bracket 50 fixed to the base 13. The motor bracket 50 is fixed to the base 13 as follows: the fixing clips 54 of the motor bracket 50 are fitted into the insertion holes 14 of the base 13. At this time, the fixing clips 54 are supported by the supporting parts 15 formed at the edges of the insertion holes 14 while the fixing clips 54 are pressed downward. Subsequently, the fixing screws 56 are inserted through the screw fixing parts 55 disposed opposite to the fixing clips 54, respectively. As a result, the motor bracket 50 is securely fixed to the base 13.

In the conventional clothing dryer, it is necessary to fix the motor bracket 50 to the base 13 at all the fixing points by the fixing screws 56. According to the motor bracket fixing structure as described above, however, the fixing clips 54 are fitted into the insertion holes 14 at one side of the base 13, and then the motor bracket 50 is fixed to the base 13 by the fixing screws 56 at the other side of the base 13. Consequently, the fixing of the motor bracket to the base is simplified, and the number of fixing units is reduced.

Figure 11:
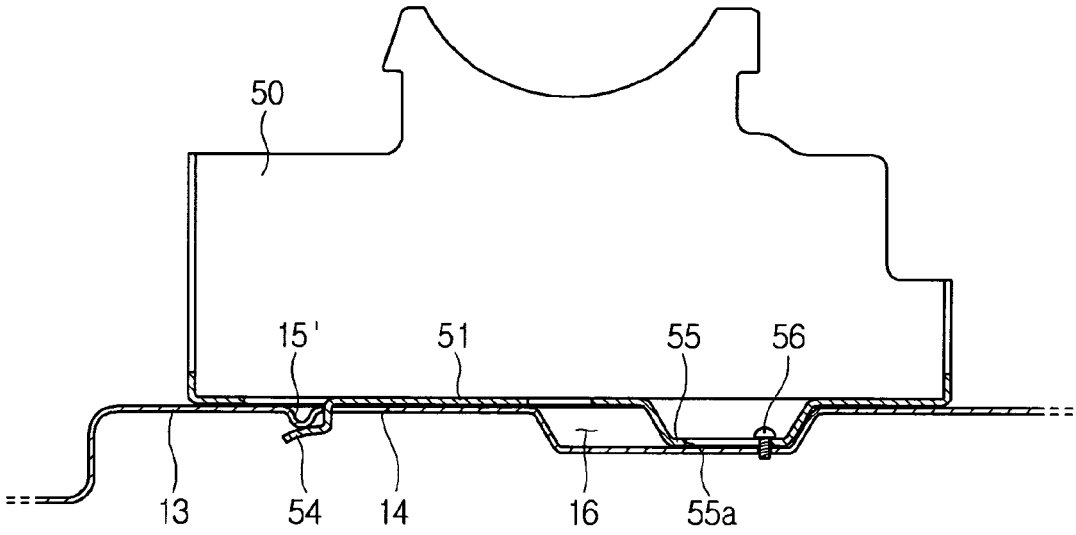
FIG. 11 is a sectional view showing a fixing structure between a motor bracket and a base of a clothing dryer according to another embodiment of the present invention.

FIG. 11 is a sectional view showing a motor bracket fixing structure of a clothing dryer according to another embodiment of the present invention. The motor bracket fixing structure according to this embodiment is identical in construction to the motor bracket fixing structure according to the previous embodiment except that the base 13 is provided around the insertion holes 14 with supporting parts 15', respectively, the supporting parts 15' being embossed. Therefore, other components of the motor bracket fixing structure according to this embodiment, which correspond to those of the motor bracket fixing structure according to the previous embodiment, are indicated by the same reference numerals as those of the motor bracket fixing structure according to the previous embodiment, and a detailed description thereof will not be given.

As apparent from the above description, the blowing fan is fixed by the fixing member when the blowing fan is disassembled or assembled, and therefore, the driving shaft is fixed. Consequently, the present invention has the effect of easily loosening or fastening the fixing nuts, by which the blowing fan is fixed to the driving shaft.

According to the present invention, the supporting rib formed at the rear part of the fan casing prevents the fan casing from shaking. Consequently, the present invention has the effect of accomplishing smooth operation of the blowing fan and preventing the blowing fan or the fan casing from being damaged.

According to the present invention, the supporting rib of the fan casing serves to hermetically seal the space around the shaft through-hole. Consequently, the present invention has the effect of preventing foreign matter, such as dust or shag, from flowing out of the fan casing through the shaft through-hole.

According to the present invention, the motor bracket is fixed to the base by the fixing screws at one side of the base while the motor bracket is temporarily fixed to the base by the fixing clips at the other side of the base. Consequently, the present invention has the effect of simplifying the fixing process of the motor bracket to the base and reducing the number of parts, and therefore, improving productivity.

Although a few exemplary embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A clothing dryer comprising:

a housing forming the appearance of the clothing dryer;

a drying tub rotatably mounted in the housing;

a blowing fan to discharge air out of the drying tub;

a fan casing to guide flow of air around the blowing fan;

a driving motor to rotate the blowing fan;

a motor bracket to support the driving motor; and a fixing part to temporarily fix the blowing fan to the fan casing between the blowing fan and the fan casing such that the blowing fan cannot rotate within the fan casing when fixing units, by which the blowing fan is attached to a driving shaft of the driving motor, are loosened and tightened.

2. The dryer according to claim 1, wherein the fixing part comprises:

a fixing hole formed at the blowing fan, a predetermined fixing member being inserted through the fixing hole; and a supporting boss formed at the fan casing, the supporting boss corresponding to the fixing hole, the supporting boss having a blind bore, into which the fixing member is inserted through the fixing hole.

3. The dryer according to claim 2, wherein the motor bracket is provided with a guide hole, through which the supporting boss is inserted.

4. The dryer according to claim 1, wherein the fan casing is provided at a rear part thereof with a supporting rib extending outward, by which the fan casing is supported by the driving motor.

5. The dryer according to claim 4, wherein the supporting rib hermetically seals the space around a shaft through-hole formed at the rear part of the fan casing for allowing the driving shaft of the driving motor to be inserted therethrough.

6. The dryer according to claim 1, wherein the motor bracket is fixed to a base, which forms a bottom of the housing, the motor bracket is provided with fixing clips, and the base is provided with insertion holes, into which the fixing clips of the motor bracket are fitted, respectively.

7. The dryer according to claim 6, wherein the fixing clips are disposed at one side of the motor bracket, and the other side of the motor bracket is fixed to the base by fixing units.

8. The dryer according to claim 7, wherein the insertion holes are provided at the edges thereof with supporting parts to support the fixing clips, respectively.

9. The dryer according to claim 8, wherein the supporting parts are one of bent downward from the edges of the insertion holes and embossed, respectively.

* * * * *